United States Patent [19]

Belson

[11] 4,114,667

[45] Sep. 19, 1978

[54] CARRYING PACK FOR PHOTOGRAPHY EQUIPMENT

[76] Inventor: Alfred Belson, 1111 S. Coast Dr., #E102, Costa Mesa, Calif. 92626

[21] Appl. No.: 851,369

[22] Filed: Nov. 14, 1977

[51] Int. Cl.[2] ..... B65D 29/00

[52] U.S. Cl. ..... 150/1; 150/52 R; 224/45 R

[58] Field of Search ..... 248/168, 169, 170, 171; 224/5 R, 5 V, 26 R, 45 R, 46 R, 47; 150/1, 52 R, 52 J

[56] References Cited

U.S. PATENT DOCUMENTS

| | | | |
|---|---|---|---|
| 979,626 | 12/1910 | Wolff | 248/171 X |
| 1,490,283 | 4/1924 | Loeffelholz | 150/52 R |
| 2,118,875 | 5/1938 | Windheim | 224/5 Z |
| 2,313,593 | 3/1943 | Smith | 224/5 V |
| 2,352,794 | 7/1944 | Love | 150/52 R X |
| 2,831,583 | 4/1958 | Wright | 248/168 X |

*Primary Examiner*—Donald F. Norton
*Attorney, Agent, or Firm*—Lowe, Kikjer, Kircher, Wharton & Bowman

[57] ABSTRACT

A flexible bag has a triangular bottom panel provided with openings at its vertices for receiving the legs of a tripod. Side panels of the bag surround the tripod legs and have pockets in which related photography gear may be carried. The bag has an open top that may be tightened down on the tripod to secure the bag in place thereon. A shoulder strap facilitates carrying the bag and collapsed tripod together with the items contained in the pockets.

20 Claims, 4 Drawing Figures

CARRYING PACK FOR PHOTOGRAPHY EQUIPMENT

BACKGROUND AND SUMMARY OF THE INVENTION

This invention relates generally to an improved carrying pack and more specifically to a pack which is useful in carrying photography equipment such as a tripod, in addition to other types of articles.

Photographers and others who work with tripods frequently have the need to move the tripod and associated equipment to a new location. At present, this is an extremely inconvenient and awkward procedure, primarily because of the difficulty encountered in handling the tripod. Due to its bulk, the tripod must usually be carried by itself, and two or more trips are thus required to transfer all of the equipment from place to place. Further, the camera mounted on the tripod usually must be removed in order to prevent it from being damaged when the tripod is carried to a new location.

It is an important object of the present invention to provide a carrying pack which may be used to conveniently carry a tripod from place to place.

Another object of the invention is to provide a carrying pack for tripod which includes readily accessible pockets for containing various types of items such as photography gear and other articles.

Still another object of the invention is to provide a carrying pack of the character described that is constructed to easily accommodate movement of the tripod between the collapsed and erected position.

A further object of the invention is to provide a carrying pack of the character described that acts to stabilize the tripod when same is set up.

An additional object of the invention is to provide a carrying pack of the character described that may be quickly and easily attached to and detached from the tripod.

A still further object of the invention is to provide a carrying pack of the character described which serves as a convenient carrying bag for a wide variety of articles when detached from the tripod.

Yet another object of the invention is to provide a carrying pack of the character described which does not interfere with normal usage of the tripod or the camera mounted thereon.

Other and further objects of the invention, together with the features of novelty appurtenant thereto, will appear in the course of the following description of the drawings.

DETAILED DESCRIPTION OF THE INVENTION

In the accompanying drawings which form a part of the specification and are to be read in conjunction therewith, and in which like reference numerals are employed to indicate like parts in the various views.

Figure 3:
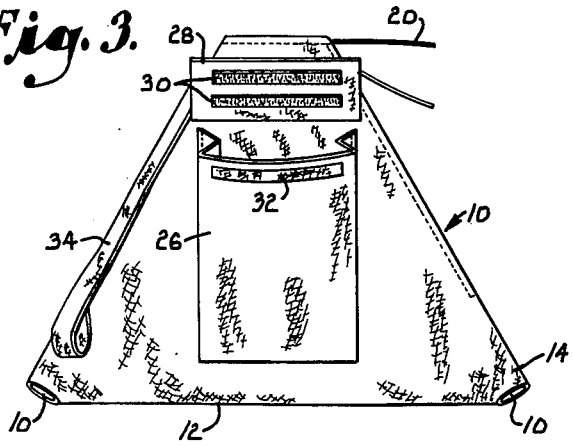
FIG. 3 is a side elevational view of the carrying pack, with one of the pockets shown in the open position.

Referring now to the drawing in greater detail, a carrying pack constructed according to the invention is in the form of a flexible bag which is generally identified by reference numeral 10. The bag 10 is in the general shape of a three sided pyramid presenting an open interior region. The bag is constructed of a sturdy, flexible fabric having substantial strength and resistance to tearing. The fabric may also be weather proof. A triangular bottom panel 12 of the bag is joined at its edges to the bottom edges of side panels 14, preferably by stitches. There are three side panels 14, and they are each in the form of a flexible fabric panel, as is the bottom panel 12. Each side 14 tapers from bottom to top, as best shown in FIG. 3. The edges of adjacent side panels 14 are joined together, again preferably by stitches.

A small circular opening 16 is formed through bottom panel 12 at each of its three vertices, or at the lower ends of the seams which connect the side panels 14. Each of the three openings 16 is hemmed around its edge for reinforcement to increase its resistance to tearing.

Figure 2:
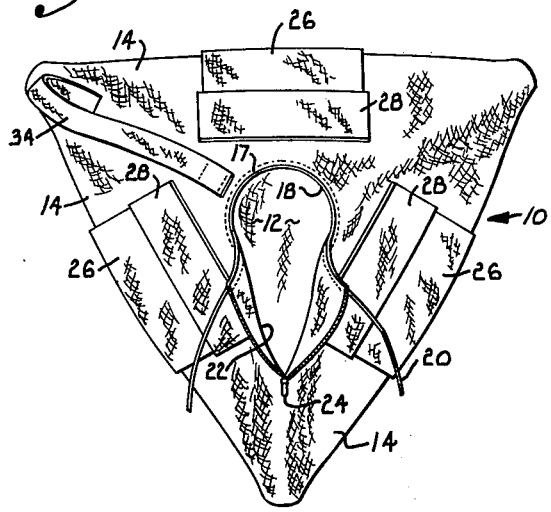
FIG. 2 is a top plan view of the carrying pack shown in FIG. 1, with the pack detached from the tripod.

The upper edges of side panels 14 cooperate to form a neck portion 17 which presents a generally circular opening 18 in the top of bag 10, as best shown in FIG. 2. The upper edge of the neck portion 17 which borders opening 18 is hemmed to provide a small passage through which a drawstring 20 is threaded. A slit 22 is formed to extend from opening 18 downwardly along a line located between two of the sides 14. A conventional zipper assembly 24 serves as a means for opening and closing slit 22, with the edges of the slit held together when the zipper is closed.

Each side panel 14 is provided with a pocket 26. As best shown in FIG. 3, each pocket 26 is a flexible fabric strip stitched at its bottom and side edges to the corresponding side panel 14. Each pocket is folded or pleated along its side and bottom portions so that it can be folded substantially flatly against its side panel when empty, or expanded to present a large compartment for receiving articles. The top of each pocket is open.

Each pocket 26 has a closure flap 28 that serves to open and close its top. One edge of flap 28 is stitched to panel 14 at a location above the pocket, and the inside surface of each flap is provided with two spaced apart closure strips 30 which may be in the form of Velcro type fasteners. Strips 30 mate with a Velcro type fastening strip 32 mounted on the outer surface of pocket 26 slightly below its upper edge. Due to the presence of two strips 30 on flap 28, the flap may close the top of pocket 26 either tightly or in a looser fashion, depending upon whether the pocket is completely or only partially filled.

Bag 10 is provided with a shoulder strap 34 which is an elongate strip formed of flexible fabric. The opposite ends of strap 34 are stitched to bag 10 at spaced apart locations on one of the seams joining adjacent side panels 14. The lower end of strap 34 is connected to the bag at a location slightly above one of the bottom openings 16, while the upper end of the strip is connected somewhat below the top opening 18.

Figure 1:
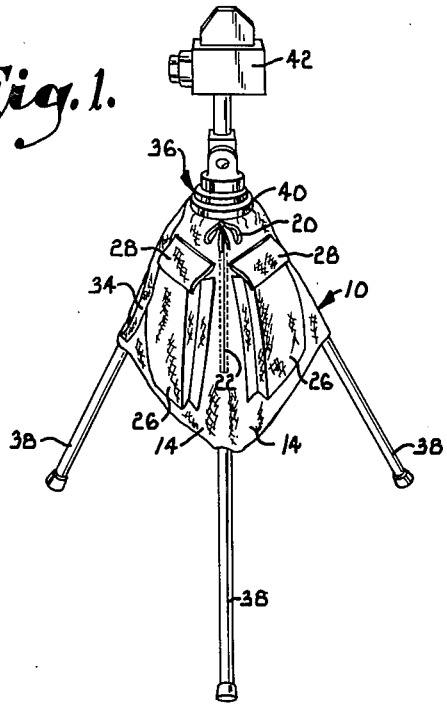
FIG. 1 is a perspective view showing a carrying pack constructed according to a preferred embodiment of the present invention attached to a tripod, with the tripod in the erect position.
Figure 4:
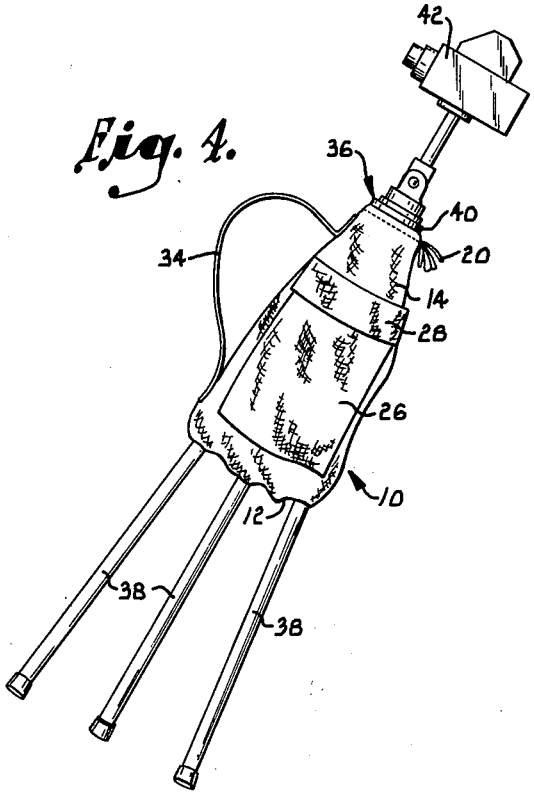
FIG. 4 is an elevational view showing the carrying pack attached to a tripod which is in the collapsed position.

Bag 10 is constructed such that it may be applied to a tripod 36 having the usual three legs 38 which may be folded in the usual manner between the spread position shown in FIG. 1 and the collapsed carrying position shown in FIG. 4. Above legs 38, the tripod includes a head portion having a collar 40 to which a camera 42 or the like may be mounted. The particular construction of the tripod is not important to the invention, and it is to be understood that the carrying pack may be adapted for use with virtually any type of tripod structure.

To attach the carrying pack to tripod 36, the tripod legs 38 are collapsed and zipper 24 is opened such that the top of the bag presents a large opening provided by the combined size of opening 18 and slit 22. Bag 10 is then slipped onto the bottom of the tripod and over its legs 38 such that the respective legs extend through openings 16. When the bag is fully installed, the bottom panel 12 extends between the tripod legs and opening 18 receives the collar 40. Zipper 24 is then closed to close slit 22, and drawstring 20 is tightened to securely tie neck portion 17 around collar 40 to secure the top portion of the bag to the tripod. The tripod legs 38 extend interiorly of the bag along the seams presented at the connected edges of sides 14.

When the tripod is set up in the erected position of FIG. 1, bottom panel 12 and side panels 14 are completely unfolded so that the bag provides a steadying influence on the tripod. Photography gear such as film and the like is contained in the pockets 26 where it is conveniently located and readily accessible when needed.

The tripod may be folded to the collapsed position shown in FIG. 4, with the flexibility of the bag material accommodating such movement of the legs. The bottom panel 12 folds up and legs 38 are able to slide axially within opening 16 if necessary. The drawstring 20 firmly maintains the top of the bag in place on the tripod. In the collapsed position, the tripod 36 may be carried with camera 42 remaining in place thereon. The additional articles are carried within pockets 26 which are preferably closed by their flaps 28. Strap 34 may be slung over the shoulder or back to carry, as a unit, bag 10, tripod 36, camera 42, and the gear contained in pockets 26. Opening 16 receives the tripod legs rather closely so that the legs are not able to move laterally in the openings to any significant extend. One of the legs 38 is maintained near strap 34 to facilitate carrying of the equipment.

When detached from the tripod, bag 10 may be used as a carrying pack for various types of articles unrelated to photography gear. Pockets 26 are able to hold a large number of items, and the large interior region within bag 10 is able to receive even larger articles. Again, shoulder strap 34 provides a convenient means for carrying the bag and the articles contained therein.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A device adapted for use to carry a tripod having a head and legs extending therefrom which are movable between a spread position and a collapsed position, said device comprising:

a neck portion presenting an opening adapted to receive the head of the tripod therethrough;

intercoupled sides extending downwardly from said neck portion, said sides being adapted to extend along each of the tripod legs;

means for securing said sides to each of the tripod legs with said legs in the spread position; and means on one of said sides adapted for use to carry the tripod.

2. A device as set forth in claim 1, wherein said device comprises a substantially hollow body and said sides are in the form of intercoupled side panels of said hollow body, there being included a bottom portion of said hollow body presenting a plurality of openings adapted to receive the respective tripod legs in extension therethrough, said bottom portion being sufficiently flexible to accommodate movement of the tripod legs between the spread and collapsed positions.

3. A device as set forth in claim 2, wherein said hollow body is in the form of a bag-like member constructed of a flexible fabric.

4. A device as set forth in claim 2, wherein said hollow body is arranged such that said side panels are adapted to be disposed in extension between respective pairs of the tripod legs when same are in the spread position and said side panels and bottom portions are intercoupled and are each constructed from flexible fabric material.

5. A device as set forth in claim 2, including a pocket on one of said side panels.

6. A device as set forth in claim 2, including:

a pocket on at least one of said side panels presenting an open mouth for receiving articles;

a flap for closing said mouth, said flap projecting from said one side panel at a location to cover said mouth; and releasable means for retaining said flap in a position to cover said mouth.

7. A device as set forth in claim 2, wherein said bottom portion is generally triangular, the openings in said bottom portion being located at approximately the vertices thereof.

8. A device as set forth in claim 2, including:

means providing a slit in said hollow body extending from the opening of said neck portion; and closure means for closing said slit.

9. A device as set forth in claim 2, including means associated with said neck portion for tightening the hollow body against said tripod.

10. A device as set forth in claim 1, wherein the last named means comprises a strap.

11. A carrying pack for use with a tripod having a head and legs extending therefrom, said carrying pack comprising:

a neck portion presenting an opening adapted to receive the head of the tripod therethrough;

intercoupled sides extending downwardly from said neck portion and adapted to extend along the tripod legs, said sides having means for securing said sides to said legs; and means on at least one of said sides presenting a pocket adapted to receive articles.

12. A carrying pack as set forth in claim 11, wherein is included a flap for closing said pocket and releasable means for retaining said flap in a position to close said pocket.

13. A carrying pack as set forth in claim 11, wherein said pack comprises a substantially hollow body and said sides are in the form of intercoupled side panels of said hollow body, there being included a bottom portion of said hollow body presenting a plurality of openings adapted to receive the respective tripod legs in extension therethrough, said bottom portion being sufficiently flexible to accommodate movement of the tripod legs between spread and collapsed positions thereof.

14. A carrying pack as set forth in claim 13, wherein said hollow body is in the form of a bag-like member constructed of a flexible fabric.

15. A carrying pack as set forth in claim 13, wherein said side panels are adapted to extend between respective pairs of legs of said tripod and said side panels and bottom portion are intercoupled and are each constructed from flexible fabric material.

16. A carrying pack as set forth in claim 15, including means presenting a pocket on each of said side panels.

17. A carrying pack as set forth in claim 13, wherein said bottom portion is generally triangular, the openings in said bottom portion being located at approximately the vertices thereof.

18. A carrying pack as set forth in claim 13, including:
means providing a slit in said hollow body extending from the opening of said neck portion; and
closure means for closing said slit.

19. A device as set forth in claim 13, including means associated with said neck portion for tightening the body against said tripod.

20. A device as set forth in claim 11, wherein is included means on one of said sides adapted for use in carrying the tripod.

* * * * *